United States Patent [19]

Rice

[11] Patent Number: 4,813,663

[45] Date of Patent: Mar. 21, 1989

[54] STAIR SLIDE

[76] Inventor: William D. Rice, 1350 Limeridge Rd. East Unit 52, Hamilton, Ontario, Canada, L8W 1L6

[21] Appl. No.: 941,593

[22] Filed: Dec. 15, 1986

[51] Int. Cl.[4] ..... A63G 21/02

[52] U.S. Cl. ..... 272/56.5 R; 272/1 R; 182/48

[58] Field of Search ..... 272/56.5 R, 1 R; 182/48; 104/69, 70

[56] References Cited

U.S. PATENT DOCUMENTS

| | | | |
|---|---|---|---|
| 726,028 | 4/1903 | Chase | 272/56.5 R |
| 788,818 | 5/1905 | Briggs et al. | 272/56.5 R |
| 880,964 | 3/1908 | Boyle | 272/56.5 R |
| 1,560,128 | 11/1925 | Youngblood | 182/48 |
| 1,699,065 | 1/1929 | Hilpert | 272/56.5 R |
| 1,699,066 | 1/1929 | Hilpert | 272/56.5 R |
| 2,270,909 | 1/1942 | Spizer | 272/56.5 R |
| 2,620,185 | 12/1952 | Harding | 272/56.5 R |
| 3,032,343 | 5/1962 | Freedberg | 272/56.5 R |
| 3,743,281 | 7/1973 | Gimbel | 272/56.5 R |
| 3,796,429 | 3/1974 | Johnston | 104/69 X |
| 3,941,337 | 3/1976 | Mölter et al. | 182/48 X |

*Primary Examiner*—Richard J. Johnson
*Assistant Examiner*—Sam Rimell

[57] ABSTRACT

The present invention provides a stair slide having an upper slide surface and a step fitting rear surface for locating and seating the slide on the stair.

1 Claim, 2 Drawing Sheets

STAIR SLIDE

FIELD OF THE INVENTION

The present invention relates to a mobile slide adapted to fit on any standard set of stairs.

BACKGROUND OF THE INVENTION

Almost all children enjoy the fun and excitement of sliding down a slide. However, for the most part, slides are an outdoor toy generally found in park areas.

There are very few products available for use as indoor slides. Therefore, some children having a daring nature and wanting to slide during the winter months will attempt to slide on a cardboard sheet or the like down the house stairs. However, this is very dangerous and totally unacceptable to the childrens parents.

SUMMARY OF THE PRESENT INVENTION

The present invention provides a slide specifically designed for fitting with a standard set of stairs and having child safety in mind. More specifically, the present invention provides a stair slide having an upper slide surface and a rear surface presenting at least one step member for locating and seating the slide on the stair. Accordingly, the child slides down the slide which remains stationary relative to the stair on which it is located to provide a natural, safe slide action.

BRIEF DISCUSSION OF THE DRAWINGS

The above, as well as other advantages and features of the present invention will be described in greater detail according to the preferred embodiment of the present invention in which.

DETAILED DESCRIPTION ACCORDING TO THE PREFERRED EMBODIMENTS OF THE PRESENT INVENTION

Figure 1:
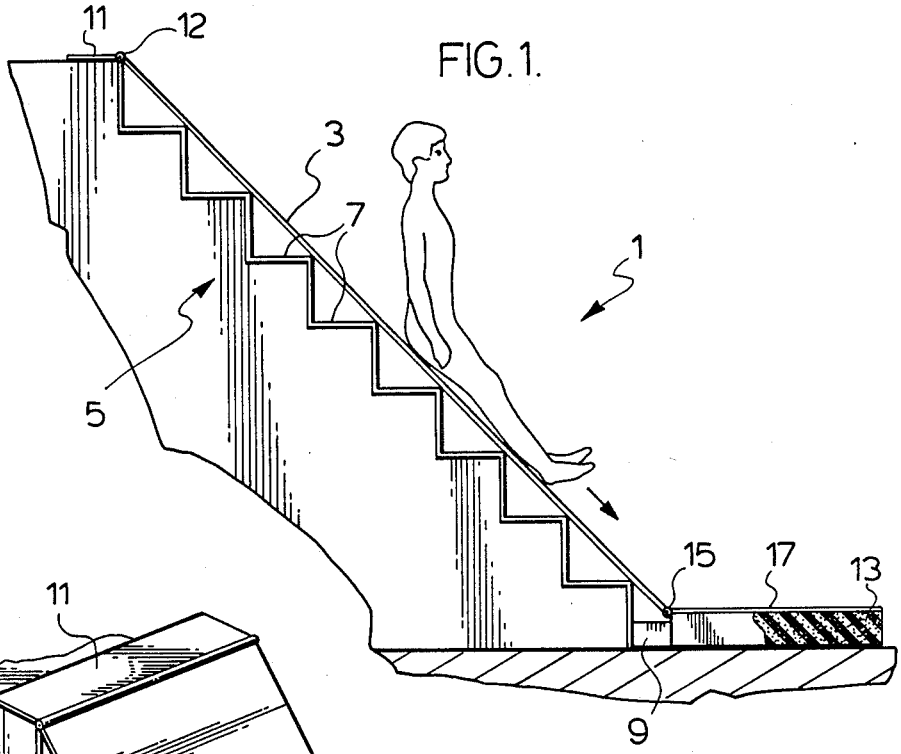
FIG. 1 is a side plan view of a child using a stair slide in accordance with a preferred embodiment of the present invention.
Figure 2:
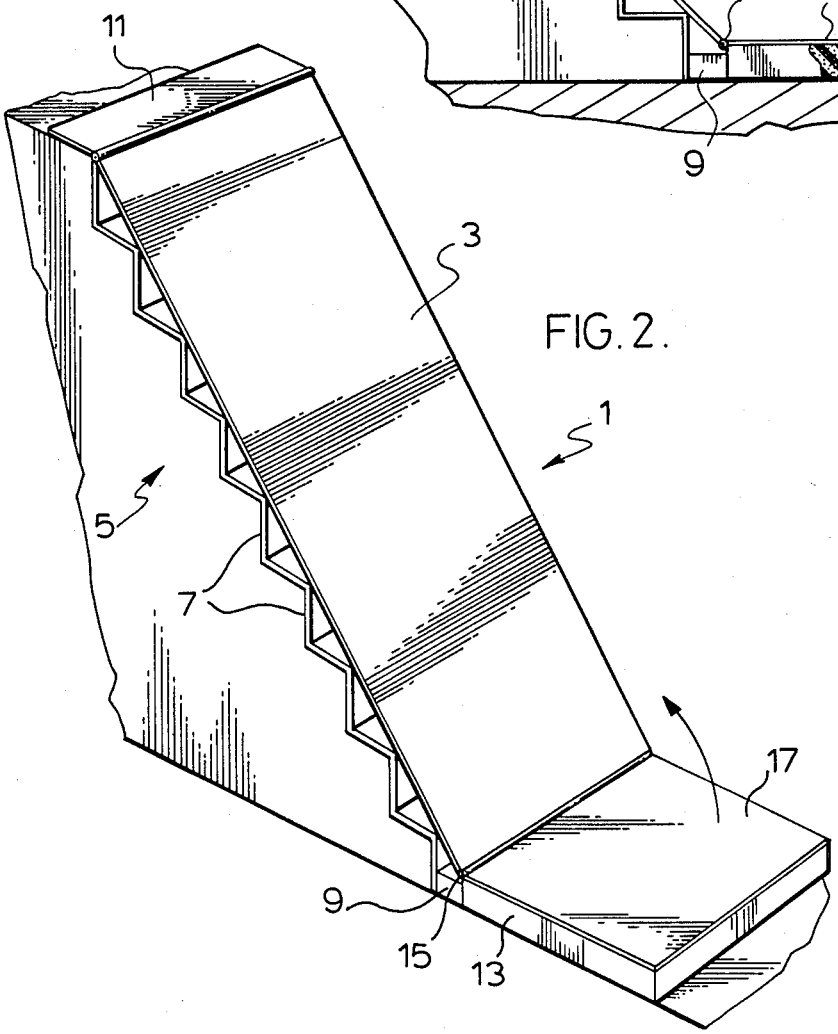
FIG. 2 is a perspective view of the stair slide of FIG. 1.

FIGS. 1 and 2 show a stair slide, generally indicated at 1. This stair slide is portable to the extent that it can be moved for use with substantially any set of standard stairs. However, at the same time, once it is positioned on those stairs it will not move while in use as shown in FIG. 1 of the drawings.

The components of the stair slide comprise an upper slide surface 3 which in the embodiment shown is generally planar. However, this surface can equally have non-planar shapes such as a hill and valley configuration.

Provided to the rear surface 5 of the slide are a plurality of step members 7. These step members are contoured to the shape of the stairs and therefore locate the slide and seat it against movement while in use. As an added feature, a floor gripping member 9, which may be in the form of a soft rubber bar or the like is provided at the lower end of the slide to assist in preventing movement in the slide which is effectively locked in position by the weight of the child.

Provided at the upper end of the slide is a movable platform 11. This platform, which is pivotally secured to the slide at 12, is bent to the stair immediately above slide surface 3 to provide a generally horizontally extending for a person mounting the slide surface. Again the bottom surface of platform 11 may be provided with gripping means to assist in stabilizing the slide against movement.

For safety purposes, the preferred embodiment stair slide is provided at its lower end with its own softened or cushioned landing surface in the form of a platform 13, having a cushioned lower surface 17. Therefore, when the child slides down the slide he or she will slide directly onto the cushioned platform rather than onto a hardened floor surface.

For storage purposes, platform 13 is pivotally secured at 15 to the slide which allows the platform to be folded to a storage position directly up against slide surface 3.

Figure 3:
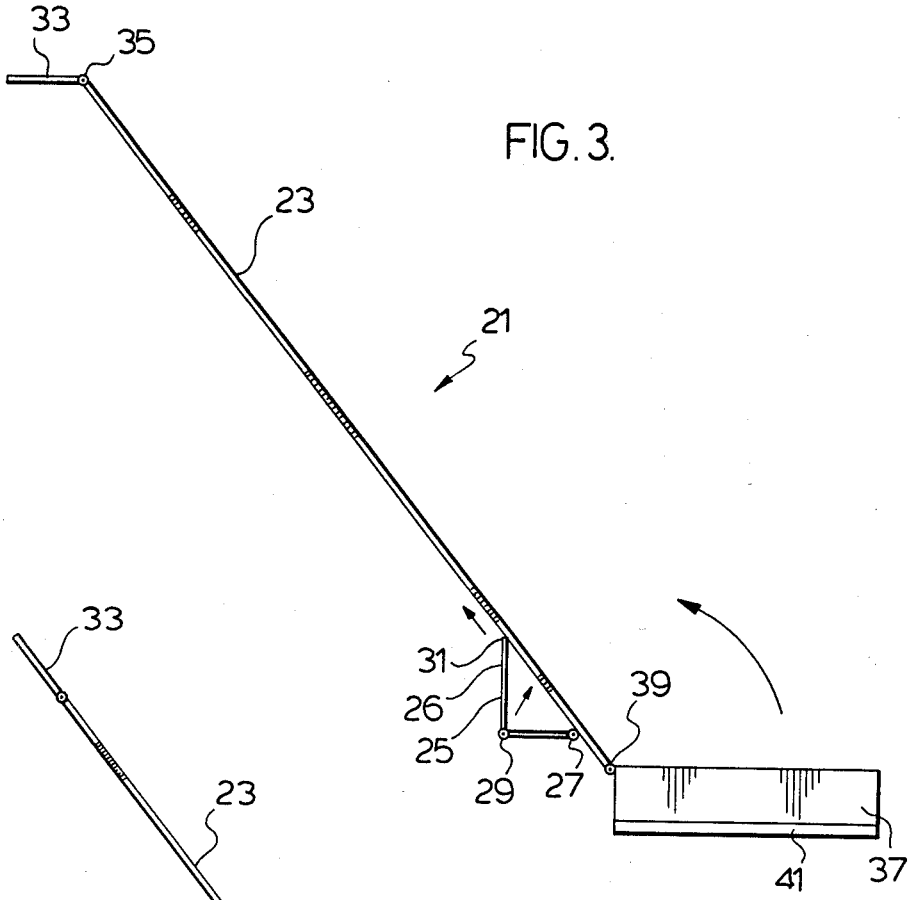
FIGS. 3 and 4 are side views of a collapsible stair slide according to a further preferred embodiment of the present invention.
Figure 4:
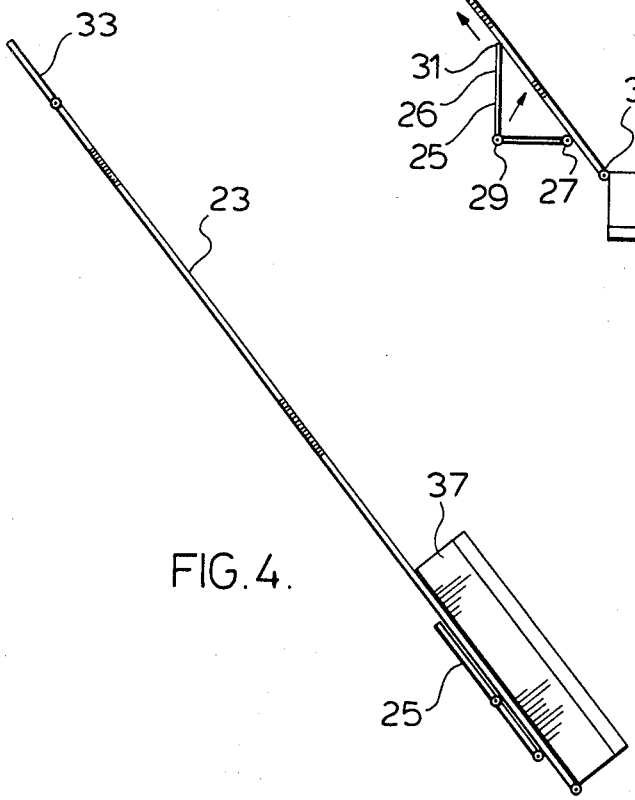

FIGS. 3 and 4 show a further preferred embodiment slide, generally indicated at 21. This slide is particularly designed with storage features in mind and includes an upper slide surface 23 with only a single step member 25 provided to the rear surface of the slide. This step member is pivotally secured at 27 to the slide and includes its own pivot region 29 which allows it to be set up in the FIG. 3 position where the step member will locate and seat the slide on a standard set of stairs. In Slide 31 includes a cushioned landing region 37, which, in this embodiment, is provided with a lower gripping surface 41, to cooperate with step member 25 in preventing movement of the slide while in use.

Provided at the upper end of the slide is a mounting platform 33 pivotally secured to slide surface 23 at 35.

Step member 25 includes a locking region 31 to hold it in the right angular position when in use. This locking region is in the form of a small groove on the back of slide surface 23 into which the upper edge of leg 36 seats and effectively locks under the weight of a child sliding down the slide. However, when relieved of load the leg 26 is quickly and easily pivoted downwardly away from the groove allowing the entire step to be collapsed and folded flat against the rear of slide surface 23. In addition, the pivotal mounting of platform 37 at 39 allows it to be folded against the front of the slide surface and the upper end platform 33 is settable to the FIG. 4 position whereby the entire slide assembly is essentially flat for storage purposes.

Typically, the slide will be made in a length to cover about 4 to 5 stairs to that the child cannot build up excessive speeds while moving down the slide. Also, at this length, the slide can quickly and easily be stored in a standard closet without taking up any substantial room.

Although various preferred embodiments of the invention have been described in detail, it will be appreciated that variations may be made without departing from the spirit of the invention or the scope of the appended claims.

The embodiments of the invention in which an exclusive property or privilege is claimed are defined as follows:

1. A stair slide having an upper slide surface and a rear surface presenting at least one step member, said step member having a right angular configuration and projecting downwardly below said stair slide for mating flushly with a stair step and being located immediately beneath said upper slide surface for supporting same and seating said slide on the stair, said stair slide having an upper end provided with a mounting platform which is pivotally secured to said upper end of said slide.

* * * * *